US009427631B1

(12) United States Patent
Larson et al.

(10) Patent No.: US 9,427,631 B1
(45) Date of Patent: Aug. 30, 2016

(54) GOLF CLUB HEAD WITH MOLDED CAVITY STRUCTURE

(71) Applicant: NIKE, Inc., Beaverton, OR (US)

(72) Inventors: Eric Larson, Arlington, TX (US); Randy Garrido, Fort Worth, TX (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/828,027

(22) Filed: Aug. 17, 2015

Related U.S. Application Data

(60) Provisional application No. 62/167,701, filed on May 28, 2015.

(51) Int. Cl.
*A63B 53/04* (2015.01)

(52) U.S. Cl.
CPC ..... *A63B 53/0466* (2013.01)

(58) Field of Classification Search
CPC ..... A63B 53/0466
See application file for complete search history.

(56) References Cited

U.S. PATENT DOCUMENTS 6,375,583 B1 4/2002 Solheim
6,616,547 B2 9/2003 Vincent et al.
7,914,393 B2 * 3/2011 Hirsch ..... A63B 53/0466 473/332
8,956,244 B1 * 2/2015 Westrum ..... A63B 53/04 473/338
9,101,811 B1 * 8/2015 Goudarzi ..... A63B 53/0466
2001/0001093 A1 * 5/2001 Murphy ..... A63B 53/04 473/305
2003/0104878 A1 6/2003 Yabu
2004/0121853 A1 * 6/2004 Caldwell ..... A63B 53/0466 473/345
2007/0004532 A1 1/2007 Lee et al.

FOREIGN PATENT DOCUMENTS

WO 2014070343 A1 5/2014

* cited by examiner

*Primary Examiner* — Michael Dennis
(74) *Attorney, Agent, or Firm* — Quinn Law Group, PLLC

(57) ABSTRACT

A golf club head includes a crown, and a sole, and further includes a forward section that includes a strike face and a body section that is coupled with the forward section. The body section has an upper portion that defines a portion of the crown and a lower portion that that defines a portion of the sole. The upper portion is formed from a molded polymeric material and includes an internal wall extending into contact with the lower portion. The lower portion defines an opening extending through the sole, and the internal wall and the crown at least partially define a cavity that is in communication with the opening.

20 Claims, 2 Drawing Sheets

GOLF CLUB HEAD WITH MOLDED CAVITY STRUCTURE

CROSS REFERENCE TO RELATED APPLICATIONS

This application claims the benefit of priority from U.S. Provisional Patent Application No. 62/167,701, filed May 28, 2015, which is hereby incorporated by reference in its entirety.

TECHNICAL FIELD

The present disclosure relates generally to a golf club head with a molded cavity structure.

BACKGROUND

A golf club may generally include a club head disposed on the end of an elongate shaft. During play, the club head may be swung into contact with a stationary ball located on the ground in an effort to project the ball in an intended direction and with a desired vertical trajectory.

Many design parameters must be considered when forming a golf club head. For example, the design must provide enough structural resilience to withstand repeated impact forces between the club and the ball, as well as between the club and the ground. The club head must conform to size requirements set by different rule setting associations, and the face of the club must not have a coefficient of restitution above a predefined maximum (measured according to applicable standards). Assuming that certain predefined design constraints are satisfied, a club head design for a particular loft can be quantified by the magnitude and location of the center of gravity, as well as the head's moment of inertia about the center of gravity and/or the shaft.

The club's moment of inertia relates to the club's resistance to rotation (particularly during an off-center hit), and is often perceived as the club's measure of "forgiveness." In typical club designs, high moments of inertia are desired to reduce the club's tendency to push or fade a ball. Achieving a high moment of inertia generally involves moving mass as close to the perimeter of the club as possible (to maximize the moment of inertia about the center of gravity), and as close to the toe as possible (to maximize the moment of inertia about the shaft). In iron-type golf club heads, this desire for increased moments of inertia have given rise to designs such as the cavity-back club head and the hollow club head.

While the moment of inertia affects the forgiveness of a club head, the location of the center of gravity behind the club face (and above the sole) generally affects the trajectory of a shot for a given face loft angle. A center of gravity that is positioned as far rearward (away from the face) and as low (close to the sole) as possible typically results in a ball flight that has a higher trajectory than a club head with a center of gravity placed more forward and/or higher.

While a high moment of inertia is obtained by increasing the perimeter weighting of the club head or by moving mass toward the toe, an increase in the total mass/swing weight of the club head (i.e., the magnitude of the center of gravity) has a strong, negative effect on club head speed and hitting distance. Said another way, to maximize club head speed (and hitting distance), a lower total mass is desired; however a lower total mass generally reduces the club head's moment of inertia (and forgiveness).

In the tension between swing speed (mass) and forgiveness (moment of inertia), it may be desirable to place varying amounts of mass in specific locations throughout the club head to tailor a club's performance to a particular golfer or ability level. In this manner, the total club head mass may generally be categorized into two categories: structural mass and discretionary mass.

Structural mass generally refers to the mass of the materials that are required to provide the club head with the structural resilience needed to withstand repeated impacts. Structural mass is highly design-dependent, and provides a designer with a relatively low amount of control over specific mass distribution. On the other hand, discretionary mass is any additional mass that may be added to the club head design for the sole purpose of customizing the performance and/or forgiveness of the club. In an ideal club design, the amount of structural mass would be minimized (without sacrificing resiliency) to provide a designer with a greater ability to customize club performance, while maintaining a traditional or desired swing weight.

SUMMARY

A golf club head includes a crown and a sole, and further includes a forward section that includes a strike face and a body section that is coupled with the forward section. The body section has an upper portion that defines a portion of the crown and a lower portion that that defines a portion of the sole. The upper portion is formed from a molded polymeric material and includes an internal wall extending into contact with the lower portion. The lower portion defines an opening extending through the sole, and the internal wall and the crown at least partially define a cavity that is in communication with the opening.

In one configuration, the internal wall is one or more internal walls, the opening is one or more openings, and the cavity is one or more cavities. The number of cavities is greater than or equal to the number of openings, and each of the one or more cavities is in communication with a respective one of the one or more openings.

The above features and advantages and other features and advantages of the present technology are readily apparent from the following detailed description when taken in connection with the accompanying drawings.

DETAILED DESCRIPTION

Figure 1:
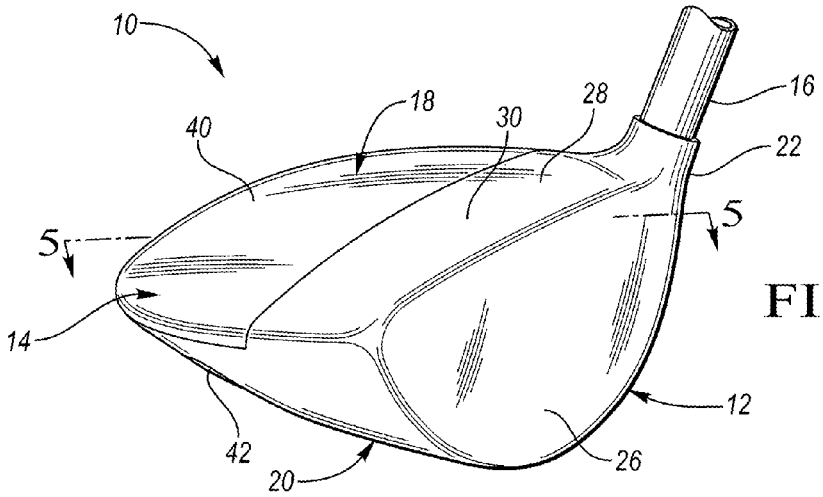
FIG. 1 is a schematic top perspective view of a golf club head.

Referring to the drawings, wherein like reference numerals are used to identify like or identical components in the various views, FIG. 1 schematically illustrates a wood-type golf club head 10 that includes a forward section 12 and a body section 14. The club head 10 may be mounted on the end of an elongate shaft 16, which may be gripped and swung by a user to impart a generally arcuate motion to the club head 10.

When the club head 10 is held in a neutral hitting position (i.e., where the shaft 16 is maintained entirely in a vertical plane and at a prescribed lie angle relative to a horizontal ground plane) the club head 10 may generally include a crown 18 and a sole 20, where the sole 20 is disposed between the ground plane and the crown 18. For the purpose of this description, the crown 18 may meet the sole 20 where the outer surface of the club head 10 has a vertical tangent (i.e., relative to the horizontal ground plane). The club head 10 may further include a hosel 22 that generally extends from the crown 18 and is configured to receive a shaft adapter or otherwise couple the club head 10 with the elongate shaft 16.

The forward section 12 of the club head 10 includes a strike face 26 that is intended to impact a golf ball during a normal swing, a frame 28 that surrounds the strike face 26, and may further include the hosel 22. Because an impact with a ball can generate considerably large stresses near the point of impact and the hosel 22, the forward section 12 may be formed from one or more metallic materials that are suitable to withstand any expected impact loading. Examples of suitable materials may include, but are not limited to, various alloys of stainless steel or titanium.

The strike face 26 generally forms the leading surface of the club head 10 and has a slight convex/arcuate curvature that extends out from the club head 10. In one embodiment, the curvature (i.e., bulge and/or roll) of the strike face 26 has a radius of from about 7 inches to about 20 inches. Additionally, as is commonly understood, the strike face 26 may be disposed at an angle to a vertical plane when the club is held in a neutral hitting position. This angle may be generally referred to as the loft angle or slope of the club. Wood-type club heads (including hybrid woods), such as illustrated in FIG. 1, may most commonly have a loft angle of from about 8.5 degrees to about 24 degrees, though other loft angles are possible and have been commercially sold.

In one configuration, the frame 28 may include a swept-back sidewall portion 30 that extends away from the strike face 26. The sidewall portion 30 may form a portion of both the sole 18 and the crown 20, and may further include one or more surface profile features, such as an indented compression channel 32. The frame 28 may be rigidly attached to the strike face 26 either through integral manufacturing techniques, or through separate processes such as welding, brazing, or adhering.

Figure 2:
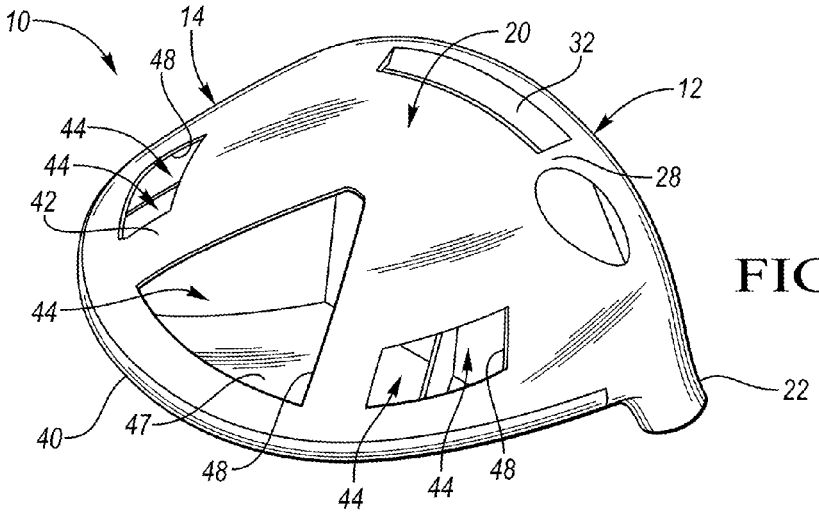
FIG. 2 is a schematic bottom perspective view of a golf club head.

The body section 14 may be coupled with the forward section 12, and may include an upper portion 40 that defines a portion of the crown 18 (as shown in FIG. 1) and a lower portion 42 that defines a portion of the sole 20 (as shown in FIG. 2). The body section 14 and forward section 12 may cooperate to generally define an internal volume, which, as will be discussed below, can be segregated into discrete sections or cavities.

To reduce the structural weight of the club head 10 while increasing the design flexibility, the upper portion 40 of the body section 14 may be formed from a molded polymeric material and adhered, or otherwise affixed to both the lower portion 42 and the forward section 12. Techniques and joint designs for adhering the upper portion 40 of the body section 14 to the lower portion 42 and/or forward section 12 are described in U.S. patent application Ser. No. 14/724,328, filed May 28, 2015 and entitled "GOLF CLUB HEAD WITH MOLDED POLYMERIC BODY" which is incorporated by reference in its entirety.

In one configuration, to achieve the desired level of design flexibility, the polymeric material may be molded into shape using a molding technique, such as, injection molding, compression molding, blow molding, thermoforming or the like. To provide the maximum design flexibility, the preferred molding technique is injection molding.

While weight savings and design flexibility are important, the polymeric material must still be strong enough to withstand the stress that is experienced when the club head 10 impacts a ball. This may be accomplished through a combination of structural and material design choices. With regard to material selection, it is preferable to use a moldable polymeric material that has a tensile strength of greater than about 200 MPa (according to ASTM D638), or more preferably greater than about 250 MPa. Additionally, for ease of molding, if the polymeric material is filled, then the material should desirably have a resin content of greater than about 40%, or even greater than about 55% by weight.

In one embodiment, the upper portion 40 of the body section 14 may be formed from a polymeric material that may be a filled thermoplastic. The filled thermoplastic may include, for example, a resin and a plurality of discontinuous fibers (i.e., "chopped fibers"). The discontinuous/chopped fibers may include, for example, chopped carbon fibers or chopped glass fibers and are embedded within the resin prior to molding the body section 14. In one configuration, the polymeric material may be a "long fiber thermoplastic" where the discontinuous fibers are embedded in a thermoplastic resin and each have a designed fiber length of from about 5 mm to about 15 mm. In another configuration, the polymeric material may be a "short fiber thermoplastic" where the discontinuous fibers are similarly embedded in a thermoplastic resin, though may each have a designed length of from about 0.01 mm to about 3 mm. Additionally, in some configurations, discontinuous chopped fibers may be characterized by an aspect ratio (e.g., length/diameter of the fiber) of greater than about 10, or more preferably greater than about 50, and less than about 1500. In one configuration, the filled polymeric material may generally have a fiber length of from about 0.01 mm to about 12 mm and a resin content of from about 40% to about 90% by weight, or more preferably from about 55% to about 70% by weight.

One suitable material may include a thermoplastic polyamide (e.g., PA6 or PA66) filled with chopped carbon fiber (i.e., a carbon-filled polyamide). Other resins may include certain polyimides, polyamide-imides, polyetheretherketones (PEEK), polycarbonates, engineering polyurethanes, and/or other similar materials.

While it is preferable for the upper portion 40 to be formed from the polymeric material, the lower portion 42 may be formed from either the polymeric material (i.e., in a similar manner as the upper portion 40), or may be alternatively formed from a metallic material. For example, in one configuration, the lower portion 42 may be formed from the same or similar metallic material as the frame 28, and may either be welded to the frame 28 or integrally formed with the frame 28.

A lower portion 42 that is formed from a polymeric material may provide advantages such as structural weight reduction and increased design flexibility. While these are beneficial qualities, a metal lower portion may also present certain advantages. For example, a metallic lower portion may provide increased durability to the sole 20, which routinely impacts the ground. Also, a metallic lower portion may provide increased sole weighting that may move the center of gravity lower (particularly when paired with a polymeric upper portion). A lower club head center of gravity tends to produce a ball impact with more spin and a higher launch angle, which are seen as desirable qualities to certain golfers and/or in connection with clubs having certain loft angles.

Referring to FIG. 2, in one configuration, the polymeric upper portion 40 and the lower portion 42 may combine to form unique club head geometries that may not be feasible with an all-metal design under current consumer-driven weight constraints. More specifically, the present polymer-body construction may provide for a wood-style club head that includes one internal cavity structures 44 ("cavities 44") that are open/exposed through the sole 20. As the cavity structures 44 become more complex or numerous, it becomes less likely that a comparable design formed from metal would satisfy desired head-weight constraints.

Figure 3:
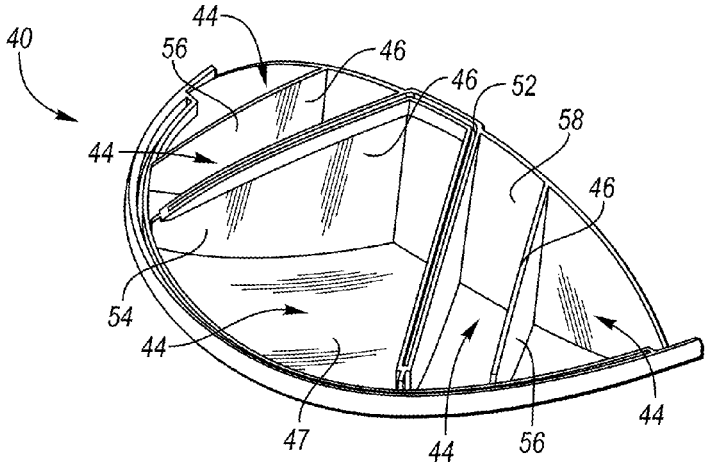
FIG. 3 is a schematic perspective view of an upper portion of the body section of a golf club head.

The cavity structure of the present design is made possible, in part, by the design of the upper portion 40 of the body structure 14. More specifically, as best shown in FIG. 3, the upper portion 40 includes one or more internal walls 46 that extend from an underside 47 of the crown 18. The one or more internal walls 46 cooperate with the crown 18 to at least partially define one or more cavities 44. When assembled, the walls 46 extend toward the lower portion 42 of the body structure 14, and at least a subset may contact, and be secured to the lower portion 42.

Figure 4:
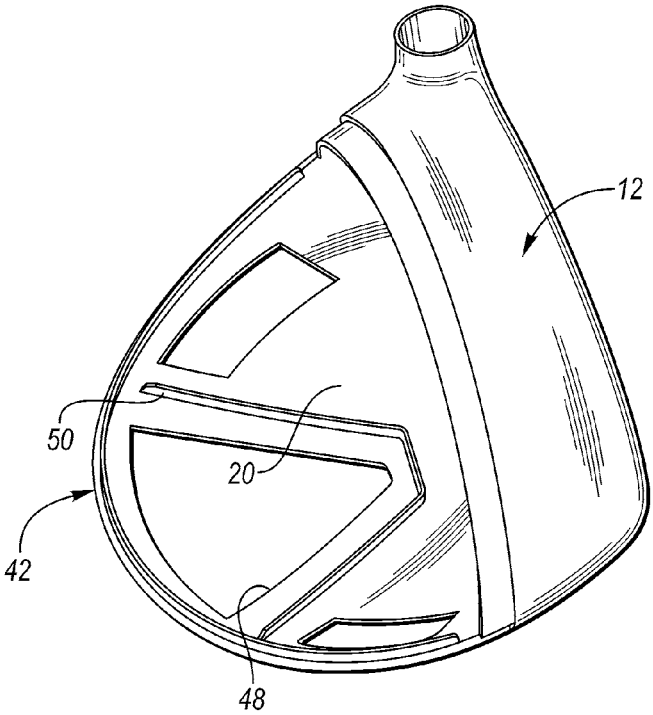
FIG. 4 is a schematic top perspective view of a golf club head, with an upper portion of the body section removed.

The lower portion 42, as shown in FIG. 4, may define one or more openings 48 that extend through the sole 20. As illustrated in both FIG. 2 and FIG. 5, each of the one or more cavities 44 may be in communication with a respective one of the one or more openings 48. In this manner, each cavity 44 may be an "open cavity" that is accessible from outside the club head 10 (i.e., contrasted with a "closed cavity" that is entirely sealed/isolated from the external environment).

If multiple openings 48 are provided, then it is important that an internal wall 46 contact the lower portion 42 between the respective openings. This is needed to ensure that the club head 10 conforms to applicable regulations and each cavity 44 is only in communication with one of the openings 48.

In one configuration, one or more of the internal walls 46 may be secured to the lower portion 42 and may be operative to stiffen the club head 10. More specifically, a secured internal wall 46 may serve as a strut or flange that reinforces the crown 18 and/or sole 20 and increases one or more modal frequencies of the structure. This stiffening may be useful in the sole 20, particularly in the vicinity of openings 48 (i.e., where the opening 48 compromises the structural integrity of the shell) and/or between adjacent openings 48. Likewise, any internal wall (though particularly walls that are secured to the lower portion 42) may stiffen/reinforce the polymeric crown 18 that would otherwise require additional thickness to match the strength of a comparable metal crown 18.

One manner of securing the polymeric, internal wall 46 to the lower portion 42 is schematically shown in FIGS. 3-4. More specifically, this design includes a tongue-in-groove style joint that enables the internal wall 46 to be adhered to the lower portion 42 via a flange 50 that extends up from the sole 20. Such a joint-design maximizes bonding area while minimizing required joint-weight and providing a smooth/continuous finish to the inside of the cavity 44.

As shown in FIGS. 3-4, the lower portion 42 includes a flange 50 that extends from the frame sole 20 and is configured to be inserted into a mating receiving portion 52 of the internal wall 46. More specifically, in one configuration, the receiving portion 52 may define a channel that is configured to receive the flange 50. When assembled, the flange 50 extends within the channel such that the receiving portion 52 extends to opposing sides of the flange 50. Once in position, the flange 50 may be secured in place using, for example, a suitable adhesive or other fastening means. Suitable adhesives may include, for example, two-part acrylic epoxies or high viscosity cyanoacrylate adhesives. This design may emphasize sheer bond strength (which is generally superior to peel strength for certain adhesive-polymer bonds) by physically permitting removal of the flange 50 only along a direction that is substantially parallel to the majority of the bond area (i.e., where the bond area is within 45 degrees of parallel to the direction of removal).

Figure 5:
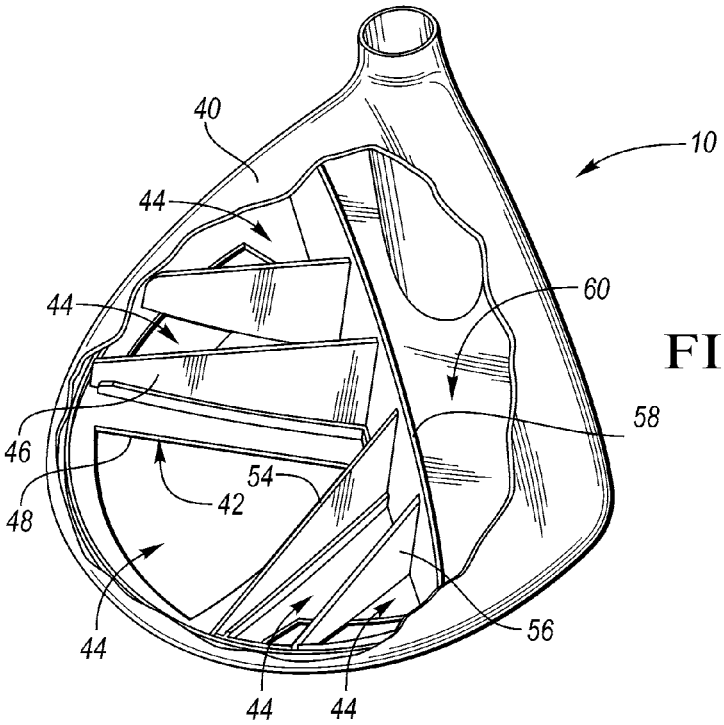
FIG. 5 is a schematic cross-sectional view of the golf club head of FIG. 1, taken along line 5-5.

In one configuration, the one or more internal walls 46 that separate adjacent openings 48 may generally be referred to as primary internal walls 54. As noted above, each primary internal wall 54 must contact the lower portion 42 and is preferably secured to the lower portion 42 to provide a structural reinforcement. In addition to any primary internal walls 54, there may also be one or more secondary internal walls 56. As shown in FIG. 5, a secondary internal wall 56 may subdivide a larger cavity into two smaller cavities that share a common opening 48. These secondary internal walls 56 need not contact the lower portion 42 and may be provided primarily for aesthetic purposes.

Finally, the upper portion 40 may include a forward wall 58 that separates the one or more cavities 44 from the forward section 12 of the club head 10. More specifically, the forward wall 58 may at least partially define a closed cavity 60 between the forward wall 58 and the forward section 12 and/or strike face 26. In one configuration, the forward wall 58 may contact and/or be affixed to the lower portion 42 and/or sole 20. Affixing the forward wall 58 to the lower portion 42 and/or sole 20 may be advantageous by preventing liquids from entering, and potentially becoming trapped within the closed cavity 60.

According to this illustrative embodiment, in one configuration, the upper portion 40 of the body section 14 may include one or more internal walls 46 that may include, for example, one or more primary walls 54, one or more secondary internal walls 56, and/or a forward wall 58. The lower portion 42 of the body section 14 may define one or more openings 48 extending through the sole 20; and the crown 20 and the one or more internal walls 46 may at least partially define one or more cavities 44, with each cavity 44 being in communication with a respective one of the one or more openings 48. In one configuration, the number of cavities 44 is greater than or equal to the number of openings 48, such as by utilizing one or more secondary internal walls 56. Likewise, the number of cavities 44 may include two or more cavities 44, and the number of cavities 44 may be greater than the number of openings 48.

In another configuration, the upper portion 40 may include a plurality of internal walls 46, where the plurality of internal walls 46 and the crown 18 at least partially define three or more cavities 44, and each of the three or more cavities 44 is in communication with a respective one of the plurality of openings. Further, the number of cavities 44 is greater than or equal to the number of openings, such as by utilizing one or more secondary internal walls 56. Additionally, in a further variation of this configuration, there may be at least two more of the cavities 44 than the openings 48, such as shown in FIG. 5. At least one of the plurality of internal walls 46 may further be a primary internal wall 54 that is adhered to the lower portion 42.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range. Each value within a range and the endpoints of a range are hereby all disclosed as separate embodiment. The terms "comprises," "comprising," "including," and "having," are inclusive and therefore specify the presence of stated items, but do not preclude the presence of other items. As used in this specification, the term "or" includes any and all combinations of one or more of the listed items. When the terms first, second, third, etc. are used to differentiate various items from each other, these designations are merely for convenience and do not limit the items.

The invention claimed is:

1. A golf club head having a strike face, a crown, and a sole, the golf club head comprising:

a forward section including the strike face;

a body section coupled with the forward section, the body section including an upper portion that defines a portion of the crown and a lower portion that that defines a portion of the sole;

wherein the upper portion is formed from a molded polymeric material and includes an internal wall extending into contact with the lower portion;

wherein the lower portion defines an opening extending through the sole; and wherein the internal wall and the crown at least partially define a cavity that is in communication with the opening.

2. The golf club head of claim 1, wherein internal wall is one or more internal walls, the opening is one or more openings, and the cavity is one or more cavities;

wherein the number of cavities is greater than or equal to the number of openings; and wherein each of the one or more cavities is in communication with a respective one of the one or more openings.

3. The golf club head of claim 2, wherein the cavity is two or more cavities.

4. The golf club head of claim 3, wherein the number of cavities is greater than the number of openings.

5. The golf club head of claim 1, wherein the internal wall is adhered to the lower portion.

6. The golf club head of claim 5, wherein the internal wall defines a receiving portion;

wherein the lower portion includes a flange extending from the sole; and wherein the flange is adhered within the receiving portion of the internal wall.

7. The golf club head of claim 1, wherein the lower portion is formed from a metallic material.

8. The golf club head of claim 7, wherein the forward section is formed from a metallic material; and wherein the lower portion is integrally formed with the forward section.

9. The golf club head of claim 1, wherein the lower portion is formed from the polymeric material.

10. The golf club head of claim 1, wherein the internal wall at least partially defines a closed cavity between the internal wall and the forward section.

11. The golf club head of claim 1, wherein the molded polymeric material is a filled thermoplastic material having a plurality of embedded fibers.

12. A golf club head having a strike face, a crown, and a sole, the golf club head comprising:

a forward section including the strike face;

a body section coupled with the forward section, the body section including an upper portion that defines a portion of the crown and a lower portion that defines a portion of the sole;

wherein the upper portion is formed from a molded polymeric material and includes a plurality of internal walls extending toward the lower portion;

wherein the lower portion defines a plurality of openings extending through the sole;

wherein the plurality of internal walls and the crown at least partially define three or more cavities, wherein each of the three or more cavities is in communication with a respective one of the plurality of openings; and wherein the number of cavities is greater than or equal to the number of openings.

13. The golf club head of claim 12, wherein there are at least two more of the cavities than the openings.

14. The golf club head of claim 12, wherein at least one of the plurality of internal walls is adhered to the lower portion.

15. The golf club head of claim 14, wherein the at least one of the plurality of internal walls defines a receiving portion;

wherein the lower portion includes a flange extending from the sole; and wherein the flange is adhered within the receiving portion.

16. The golf club head of claim 12, wherein the lower portion is formed from a metallic material.

17. The golf club head of claim 16, wherein the forward section is formed from a metallic material; and wherein the lower portion is integrally formed with the forward section.

18. The golf club head of claim 12, wherein at least one of the plurality of internal walls defines a closed cavity between the at least one internal wall and the forward section.

19. The golf club head of claim 12, wherein the molded polymeric material is a thermoplastic material.

20. The golf club head of claim 19, wherein the thermoplastic material is a filled thermoplastic material having a plurality of embedded fibers.

* * * * *